US005860469A

United States Patent [19]

Barlow

[11] Patent Number: 5,860,469

[45] Date of Patent: Jan. 19, 1999

[54] METHOD OF MANUFACTURING A CYLINDER BLOCK

[75] Inventor: John Barlow, Walsall, United Kingdom

[73] Assignee: GKN Sankey Limited, Shropshire, Great Britain

[21] Appl. No.: 817,474

[22] PCT Filed: Aug. 16, 1996

[86] PCT No.: PCT/GB96/02010

§ 371 Date: Apr. 14, 1997

§ 102(e) Date: Apr. 14, 1997

[87] PCT Pub. No.: WO97/06908

PCT Pub. Date: Feb. 27, 1997

[30] Foreign Application Priority Data

Aug. 19, 1995 [GB] United Kingdom ..... 9517045

[51] Int. Cl.[6] ..... B22D 19/08; B22D 17/00; F02F 1/10; F02F 7/00

[52] U.S. Cl. ..... 164/98; 164/94; 164/95; 164/113; 123/41.74; 123/41.84; 123/193.1; 123/193.2; 29/888.061

[58] Field of Search ..... 164/98, 113, 94, 164/95; 29/888.061; 123/193.1, 193.2, 41.74, 41.84

[56] References Cited

U.S. PATENT DOCUMENTS

| | | | |
|---|---|---|---|
| 4,068,645 | 1/1978 | Jenkinson | 123/193.2 |
| 4,297,976 | 11/1981 | Bruni et al. | 123/193.2 |
| 4,846,116 | 7/1989 | Sakurahara et al. | 123/41.74 |
| 5,255,433 | 10/1993 | Jin et al. | 164/97 |
| 5,303,682 | 4/1994 | Donahue et al. | 123/193.1 |
| 5,387,272 | 2/1995 | Kamitsuma et al. | 75/230 |
| 5,421,397 | 6/1995 | Hembree et al. | 164/113 |
| 5,462,108 | 10/1995 | Katoh et al. | 164/98 |
| 5,537,969 | 7/1996 | Hata et al. | 123/41.84 |

FOREIGN PATENT DOCUMENTS

| | | | |
|---|---|---|---|
| 110406 | 6/1984 | European Pat. Off. | 123/41.74 |
| 0 554 575 | 8/1993 | European Pat. Off. . | |
| 55-96341 | 7/1980 | Japan | 123/41.84 |
| 61-157743 | 7/1986 | Japan | 29/888.061 |
| 4-76252 | 3/1992 | Japan | 29/888.061 |
| 2 211 207 | 6/1989 | United Kingdom . | |
| WO 92/15415 | 9/1992 | WIPO . | |

*Primary Examiner*—Patrick Ryan
*Assistant Examiner*—I. H. Lin
*Attorney, Agent, or Firm*—Marshall, O'Toole, Gerstein, Murray & Borun

[57] ABSTRACT

A method of manufacturing a cylinder block comprising one or more cylinders, the or each cylinder being adapted to receive a piston therein, the method comprising making a cylinder liner by squeeze casting, in an aluminium-silicon alloy produced from a melt consisting essentially of the following composition by weight: Silicon 14% to 16%; Copper 1.9% to 2.2%; Nickel 1.0% to 1.4%; Magnesium 0.4% to 0.55%; Iron 0.6% to 1.0%; Manganese 0.3% to 0.6%; Silicon Modifier 0.02% to 0.1%, with the balance being aluminium and any avoidable impurities, the cylinder liner having an essentially eutectic microstructure containing not more than 10% primary alpha-aluminium dendrites and being substantially free from intermetallic particles exceeding 10 $\mu$ in diameter, placing the cylinder block in a mold and casting therearound an aluminium alloy to provide a main cylinder block body with the cylinder liner entrapped therein.

20 Claims, 2 Drawing Sheets

METHOD OF MANUFACTURING A CYLINDER BLOCK

DESCRIPTION OF THE INVENTION

This invention relates to a method of manufacturing a cylinder block.

In our previous application published under No. GB 2211207, there is disclosed a method of making a cylinder liner from a eutectic aluminium silicon alloy.

Such cylinder liners have been used in worn engines, and to replace conventional cast iron cylinder liners in for example, high performance engines. In the latter case, existing cast iron cylindrical liners are drilled out of the cylinder block and replaced with a cylinder liner made in the eutectic aluminium silicon alloy.

Conventionally, such cylinder liners have comprised a single cylindrical part, a plurality of such cylinder liners being used in an engine block which comprises a plurality of cylinders.

Cylinder liners made of the eutectic aluminium silicon alloy have significant advantages over cast iron cylinder liners in that the expansion of the cylinder liner as it becomes hot, is similar to that of the engine block. In engine blocks which utilise cast iron liners, particularly in high performance engines, the differential expansion which occurs between the cast iron cylinder liner, and the aluminium alloy cylinder block can result in failure of the cylinder liner and even of the cylinder block.

It has been proposed in European application 0 554 575 to manufacture a cylinder block by integrally casting in a cylinder liner made of cast iron. The resultant construction may however have problems due to the different shrinkage characteristics of the aluminium engine block. Further, the resulting structure will suffer from the same problems as a structure comprising an aluminium cylinder block into which a cast iron cylinder block is fitted, due to the different expansion characteristics of the iron and aluminium alloy.

SUMMARY OF THE INVENTION

According to a first aspect of the invention we provide a method of manufacturing a cylinder block comprising at least one cylinder, said at least one cylinder being adapted to receive a piston therein, the method comprising making a cylinder liner by squeeze casting, in an aluminium-silicon alloy produced from a melt consisting essentially of the following composition by weight:

| | |
|---|---|
| Silicon | 14% to 16% |
| Copper | 1.9% to 2.2% |
| Nickel | 1.0% to 1.4% |
| Magnesium | 0.4% to 0.55% |
| Iron | 0.6% to 1.0% |
| Manganese | 0.3% to 0.6% |
| Silicon Modifier | 0.02% to 0.1% |

with the balance being aluminium and any avoidable impurities, the cylinder liner having an essentially eutectic microstructure containing not more than 10% primary alpha-aluminium dendrites and being substantially free from intermetallic particles exceeding 10 $\mu$ in diameter, placing the cylinder liner in a mould and casting therearound an aluminium alloy to provide a main cylinder block body with the cylinder liner entrapped therein.

As described in our previous application 2211207, the material in which the cylinder liner is made, is ideal for use as a cylinder liner for insertion in a pre-formed cylinder block. By casting the cylinder block body around the cylinder liner in accordance with the present invention, the resultant structure is significantly improved compared with a structure in which the cylinder liner is inserted into the pre-cast cylinder block. Also, because the characteristics of the material from which the cylinder liner is made, and the aluminium alloy of the cylinder block are so similar, the method of the invention provides no significant technical problems which could occur in arrangements such as described in European application 0554575 when a dissimilar metal is cast around the cast iron cylinder liner.

In a preferred arrangement, the main cylinder block is diecast around the cylinder liner, although other casting methods could be employed.

Because the melting temperature of the cylinder liner will be similar to that of the aluminium alloy from which the main cylinder block is made, preferably during casting of the main cylinder block body around the cylinder liner, the cylinder liner is cooled. This may conveniently be achieved by passing coolant through the or each cylindrical opening of the cylinder liner.

During casting, the outermost surface of the cylinder liner may become molten to a small degree, but this will assist in keying-in the cylinder liner to the aluminium alloy of the main cylinder block body which is cast therearound.

The method of the invention is particularly useful when making a cylinder liner which comprises an integral body for lining a plurality of cylinders.

Thus there is less risk of misalignment between a plurality of cylinder liners placed in a mould into which the aluminium alloy of the main cylinder block body is cast.

The integral body may comprise a plurality of cylindrical parts which line the cylinders, each cylindrical part of the adjacent pair, or of at least one of the, adjacent pairs, of cylindrical parts, being connected together by a web, and each cylindrical part having an outer radius from its centre to an outermost surface of the cylindrical part, the distance between the centres of two respective adjacent cylindrical parts being less than the sum of the outer radii of the respective cylindrical parts.

Where the integral body comprises a plurality of cylindrical parts which line the cylinders, each cylindrical part may have a respective wall thickness, each cylindrical part of the adjacent pair, or of at least one of the adjacent pairs of cylindrical parts being connected together by a web, the thickness of the web along a line connecting the centres of the two respective cylindrical parts of the pair, being less than the combined wall thicknesses of the two cylindrical parts.

Hence particularly where space is at a premium, it is possible for the cylinders to be more closely nested together than otherwise would be the case. The web between adjacent cylindrical parts may be of substantially the same thickness as a single respective wall thicknesses, so that the strength of the cylinder liner wall is not compromised.

If desired, the cylinder liner may be made with at least one integral wall part which provides a cooling passage through which coolant may subsequently flow when the cylinder block is in use. For example, in an arrangement having a plurality of cylindrical parts connected by a web or webs, such a wall part may extend between the outermost surfaces of two adjacent cylindrical parts and a cooling passage may be provided between the wall part, the web and the outermost surfaces of the two adjacent cylindrical parts.

The invention is particularly but not exclusively applicable where the cylinder block is that of an internal combustion engine.

The aluminium alloy may be any suitable alloy for casting a cylinder block for a desired application and typically comprises an aluminium alloy conventionally used for the cylinder block concerned. For example in the case of a cylinder block of an internal combustion engine LM25 alloy (ISO Al—Si7Mg).

As will be known to those skilled in the art, the technique of squeeze casting essentially comprises introducing liquid metal into a first part of a mould, closing the mould under pressure so that the liquid metal fills the mould cavity without entrapping air, maintaining the metal under pressure whilst solidification takes place so as to ensure that any shrinkage cavities which may form are closed and filled, and then opening the mould and removing the formed article.

The squeeze casting process is thus different from gravity, low pressure or high pressure casting in that solidification of the melt takes place under conditions of sustained temperature and pressure. Typically the pressure applied to the melt may be of the order of 70 MPa and may be sustained for a period of time of the order of 40 seconds. The solidification parameters of the squeeze casting process are different to those obtaining in other known casting processes and hence, in accordance with the method of the invention, the desired microstructure can be obtained at a solidification growth rate R of the solid phase from 1,000 to 2,500 $\mu$/s whilst omitting zirconium and titanium from the composition. Specifically, titanium is not required as the desired degree of grain refinement is found to be present in the as-formed article as a direct consequence of the squeeze forming method of production.

According to a second aspect of the invention we provide a cylinder block comprising a cylinder, said at least one cylinder being adapted to receive a piston therein, comprising a main cylinder block body comprising an aluminium alloy and cast in said body, so as to be entrapped therein, a cylinder liner comprising an aluminium-silicon alloy consisting essentially of the following composition by weight:

| | |
|---|---|
| Silicon | 14% to 16% |
| Copper | 1.9% to 2.2% |
| Nickel | 1.0% to 1.4% |
| Magnesium | 0.4% to 0.55% |
| Iron | 0.6% to 1.0% |
| Manganese | 0.3% to 0.6% |
| Silicon Modifier | 0.02% to 0.1% |

with the balance being aluminium and any avoidable impurities, the cylinder liner having an essentially eutectic microstructure containing not more than 10% primary alpha-aluminium dendrites and being substantially free from intermetallic particles exceeding 10 $\mu$ in diameter.

The cylinder liner may comprise an integral body for lining a plurality of cylinders.

The integral body may comprise a plurality of cylindrical parts which line the cylinders, each cylindrical part or each adjacent pair of cylindrical parts being connected together by a web, and each cylindrical part having an outer radius from its centre to an outermost surface of the cylindrical part, the distance between the centres of two adjacent cylindrical parts being less than the sum of the outer radii of the respective cylindrical parts.

The integral body may comprise a plurality of cylindrical parts which line the cylinders, each cylindrical part having a respective wall thickness, the or each adjacent pair of cylindrical parts being connected together by a web, the thickness of the web along a line connecting the centres of the two cylindrical parts of the pair, being less than the combined wall thicknesses of the two cylindrical parts.

The cylinder liner may have at least one integral wall part which provides a cooling passage through which coolant may subsequently flow when the cylinder block is in use.

The wall part may extend between the outer surfaces of two adjacent cylindrical parts and the cooling passages provided between the wall part, the web and the outer surfaces of the two adjacent cylindrical parts.

The cylinder block may be a cylinder block of an internal combusion engine.

BRIEF DESCRIPTION OF THE DRAWINGS

The invention will now be described with reference to the accompanying drawings in which.

Figure 1:
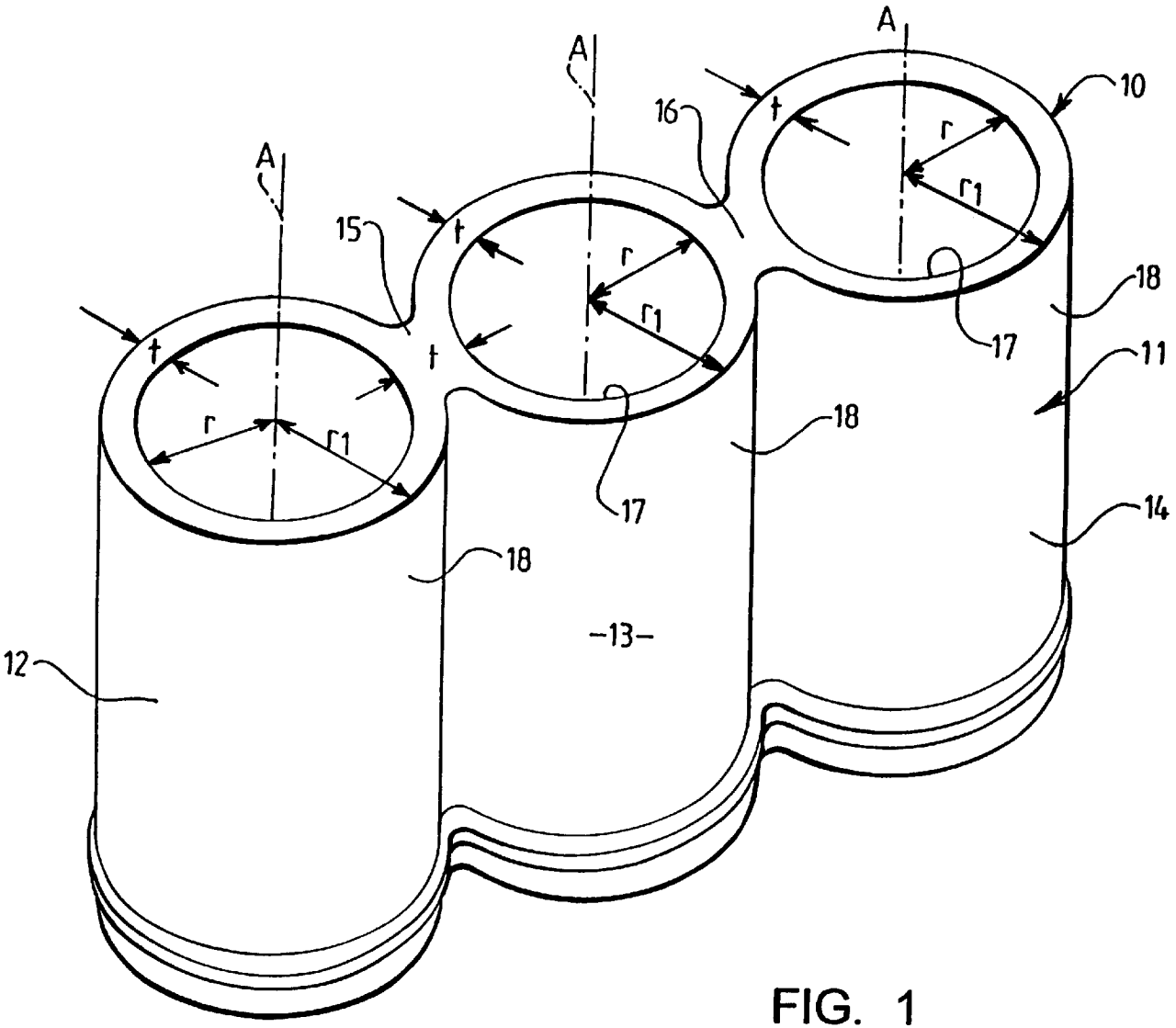
FIG. 1 is an illustration of a cylinder liner made in a eutectic aluminium silicon alloy for use in the method of the present invention.

Referring to the drawings, a cylinder liner 10 comprises an integral body 11 comprising three cylindrical parts 12, 13 and 14, with cylindrical parts 12 and 13 connected by a first web part 15, and cylindrical parts 13 and 14 connected by a second web part 16.

The cylinder liner 10 is made by what is now a conventional squeeze-casting method, in an aluminium silicon alloy produced from a melt consisting of the following ingredients:

| | |
|---|---|
| Silicon | 14% to 6% |
| Copper | 1.9% to 2.2% |
| Nickel | 1.0% to 1.4% |
| Magnesium | 0.4% to 0.55% |
| Iron | 0.6% to 1.0% |
| Manganese | 0.3% to 0.6% |
| Strontium | 0.02% to 0.08% |

with the balance being aluminium and any incidental and preferably avoidable impurities.

Strontium acts as a silicon modifier. If desired another suitable silicon modifier may be provided in the range 0.0% to 0.10%.

During the squeeze-casting of the cylinder liner to the above composition, the growth rate R of the solid phase during solidification was from 1,000 to 2,500 $\mu$/s and the temperature gradient G at the solid/liquid interface, expressed in °C./cm, was such that the ratio G/R was from 100 to 1,000° Cs/cm$^2$.

The microstructure of the cylinder liner was found to be essentially eutectic containing not more than 10% of primary alpha-aluminium dendrites and being substantially free from intermetallic particles exceeding 10 $\mu$ in diameter.

The liner 10 was then given a full heat treatment process being a solution treatment of heating and holding the liner 10 at approximately 480° C. to 530° C. for between five and twenty hours, quenching the liner 10 into hot water and then artificially ageing it by reheating and holding at a temperature of around 140° C. to 250° C. for a time between two and thirty hours. This changed the microstructure of the material and as a result, the average mechanical properties of the cylinder liner were:

| | |
|---|---|
| UTS | 350 to 380 MPa |
| Hardness (BHN) | 130 to 160 |
| 0.2% Compressive YS | 400 to 450 MPa |

Under sliding wear conditions the wear resistant properties of the cylinder liner 10 produced are found to be excellent, the advantages of squeeze-casting being that the cylinder liner 10 is produced to a high density without air entrapment in a relatively short production cycle time whilst also benefitting from the desirable properties of the essentially eutectic microstructure. Also, by utilisation of a squeeze-casting process, the expensive alloying elements of zirconium and titanium can be omitted.

It can be seen that each cylindrical part 12-14 of the cylinder liner 10 has an internal radius r from its axis A to an internal surface 17, and an outer radius r' between the axis A and the external outermost surface 18, there being a resultant wall thickness t being the difference between r' and r.

Although in the arrangement shown in FIG. 1, the distance d between the axes A of two adjacent cylindrical parts, e.g. cylindrical parts 12 and 13, is greater than 2r'. In another arrangement the distance between the axes A of two adjacent cylindrical parts e.g. 12 and 13 may be less than the sum of the outer radii r' of the respective cylindrical parts 12 and 13. Alternatively expressed, the thickness t' of the web e.g. 15, along a line connecting the axes A of the two cylindrical parts 12 and 13 of the pair, may be less than the combined wall thicknesses 2t of the two cylindrical parts 12, 13.

In a method in accordance with the invention, the cylinder liner 10 thus made is placed in a mould and aluminium alloy is cast therearound to provide a main cylinder block body 20 with the cylinder liner 10 entrapped therein. The aluminium alloy may be any suitable alloy for casting a cylinder block for a desired application and typically comprises an aluminium alloy conventionally used for the cylinder block concerned. For example in the case of a cylinder block of an internal combustion engine LM25 alloy (ISO Al—Si7Mg).

Preferably the main cylinder block body is diecast around the cylinder liner 10 although any other desired casting methods could be used.

During casting of the main cylinder block body, if desired, coolant may be passed through the cylindrical opening of each of the cylindrical parts 12, 13 and 14 to cool the cylinder liner 10, and prevent any distortion of the cylinder liner 10. During casting, the outermost surfaces 18 of the cylindrical parts 12, 13 and 14 may become molten to a small degree, but this will improve keying in of the cylinder liner 10 to the main cylinder block body 20.

Any other desired means for cooling the cylinder liner 10 during casting of the main cylinder block body 20 may be utilised as desired.

Various modifications may be made without departing from the scope of the invention.

Figure 2:
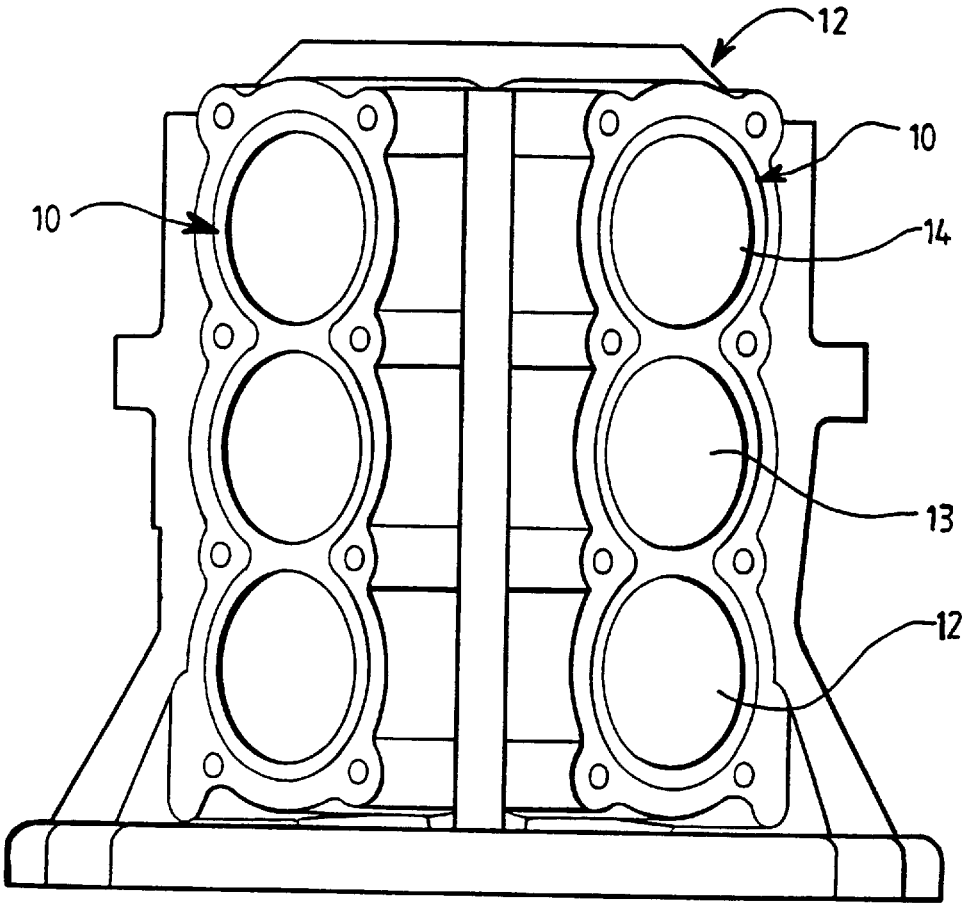
FIG. 2 is an illustrative view of a cylinder block including the cylinder liner of FIG. 1, made by the method of the invention.

Particularly, although in the example shown in FIG. 1, the cylinder liner 10 has three cylindrical parts 12, 13 and 14, the integral body 11 may comprise only two cylindrical parts, or more than three as desired. As will be seen from FIG. 2, the arrangement of FIG. 1 is intended for use in a V-shaped cylinder block 20, which accommodates six cylinders, in a V formation.

Other modifications may be made. For example, cooling passages may be provided between integral wall parts which extend between the external outermost surfaces 18 of two adjacent cylindrical parts e.g. 12 and 13, the cooling passages being provided between the integral wall parts, the adjacent web e.g. 15, and the outer surfaces 18 of the two adjacent cylindrical parts e.g. 12 and 13.

Although the invention has been described in relation to a cylinder block being that of an internal combustion engine, the invention may be applied to cylinder blocks for other applications.

The features disclosed in the foregoing description, or the following claims, or the accompanying drawings, expressed in their specific forms or in terms of a means for performing the disclosed function, or a method or process for attaining the disclosed result, as appropriate, may, separately or in any combination of such features, be utilised for realising the invention in diverse forms thereof.

I claim:

1. A method of manufacturing a cylinder block comprising at least one cylinder, said at least one cylinder being adapted to receive piston therein, the method comprising making a cylinder liner by squeeze casting, the cylinder liner comprising an aluminium-silicon alloy produced from a melt consisting essentially of the following composition by weight:

Silicon 14% to 16%
Copper 1.9% to 2.2%
Nickel 1.0% to 1.4%
Magnesium 0.4% to 0.55%
Iron 0.6% to 1.0%
Manganese 0.3% to 0.6%
Silicon Modifier 0.02% to 0.1% with the balance being aluminium and any avoidable impurities, the cylinder liner having an essentially eutectic microstructure containing not more than 10% primary alpha-aluminium dendrites and being substantially free from intermetallic particle exceeding 10 $\mu$ in diameter, placing the cylinder liner in a mould and casting therearound an aluminium alloy to provide a main cylinder block body with the cylinder liner entrapped therein.

2. A method according to claim 1 wherein the main cylinder block is diecast around the cylinder liner.

3. A method according to claim 1 wherein during casting of the main cylinder block body around the cylinder liner, the cylinder liner is cooled.

4. A method according to claim 3 wherein cooling of the cylinder liner during casting of the main cylinder block body is achieved by passing coolant through the or each cylindrical opening of the cylinder liner.

5. A method according to claim 1 wherein the method comprises making a cylinder liner which comprises an integral body for lining a plurality of cylinders.

6. A method according to claim 5 wherein the integral body comprises a plurality of cylindrical parts which line the cylinders, each cylindrical part of the adjacent pair, or of at least one of the adjacent pairs of cylindrical parts being connected together by a web, and each cylindrical part having an outer radius from its centre to an outermost surface of the cylindrical part, the distance between the centres of two respective adjacent cylindrical parts being less than the sum of the outer radii of the respective cylindrical parts.

7. A method according to claim 6 wherein the cylinder liner is made with at least one integral wall part which provides a cooling passage through which coolant may subsequently flow when the cylinder block is in use and wherein the wall part extends between the outer surfaces of two adjacent cylindrical parts and the cooling passage is provided between the wall part, the web and the outer surfaces of the two adjacent cylinder parts.

8. A method according to claim 5 wherein the integral body comprises a plurality of cylindrical parts which line the cylinders, each cylindrical part having a respective wall thickness, each cylindrical part of the adjacent pair, or of at least one of the adjacent pairs of cylindrical parts being connected together by a web, the thickness of the web along a line connecting the centres of the two respective cylindrical parts of the pair, being less than the combined wall thicknesses of the two cylindrical parts.

9. A method according to claim 8 wherein the cylinder liner is made with at least one integral wall part which provides a cooling passage through which coolant may subsequently flow when the cylinder block is in use and wherein the wall part extends between the outer surfaces of two adjacent cylindrical parts and the cooling passage is provided between the wall part, the web and the outer surfaces of the two adjacent cylinder parts.

10. A method according to claim 1 wherein the cylinder liner is made with at least one integral wall part which provides a cooling passage through which coolant may subsequently flow when the cylinder block is in use.

11. A method according to claim 1 wherein the cylinder block is of an internal combustion engine.

12. A cylinder block comprising at least one cylinder, said at least one cylinder being adapted to receive a piston therein, the cylinder block being made by a method comprising making a cylinder liner by squeeze casting, the cylinder liner comprising an aluminum-silicon alloy produced from a melt consisting essentially of the following composition by weight:

Silicon 14%

Copper 1.9% to 2.2%

Nickel 1.0% to 1.4%

Magnesium 0.4% to 0.55%

Iron 0.6% to 1.0%

Manganese 0.3% to 0.6%

Silicon Modifier 0.02% to 0.1% with the balance being aluminum and any avoidable impurities, the cylinder liner having an essentially eutectic microstructure containing not more than 10% primary-alpha-aluminum dendrites and being substantially free from intermetallic particles exceeding 10 $\mu$ in diameter, placing the cylinder liner in a mould and casting therearound an aluminum alloy to provide a main cylinder block body with the cylinder liner entrapped therein.

13. A cylinder block comprising at least one cylinder, said at least one cylinder being adapted to receive a piston therein, comprising a main cylinder block body comprising an aluminium alloy and cast in said body, so as to be entrapped therein, a cylinder liner comprising an aluminium-silicon alloy consisting essentially of the following composition by weight:

| | |
|---|---|
| Silicon | 14% to 16% |
| Copper | 1.9% to 2.2% |
| Nickel | 1.0% to 1.4% |
| Magnesium | 0.4% to 0.55% |
| Iron | 0.6% to 1.0% |
| Manganese | 0.3% to 0.6% |
| Silicon Modifier | 0.02% to 0.1% |

with the balance being aluminium and any avoidable impurities, the cylinder liner having an essentially eutectic microstructure containing not more than 10% primary alpha-aluminium dendrites and being substantially free from intermetallic particles exceeding 10 $\mu$ in diameter.

14. A cylinder block according to claim 13 wherein the cylinder liner comprises an integral body for lining a plurality of cylinders.

15. A cylinder block according to claim 14 wherein the integral body comprises a plurality of cylindrical parts which line the cylinders, each cylindrical part or each adjacent pair of cylindrical parts being connected together by a web, and each cylindrical part having an outer radius from its centre to an outermost surface of the cylindrical part, the distance between the centres of two adjacent cylindrical parts being less than the sum of the outer radii of the respective cylindrical parts.

16. A cylinder block according to claim 15 wherein the cylinder liner has at least one integral wall part which provides a cooling passage through which coolant may subsequently flow when the cylinder block is in use and wherein the wall part extends between the outer surfaces of two adjacent cylindrical parts and the cooling passages provided between the wall part, the web and the outer surfaces of the two adjacent cylindrical parts.

17. A cylinder block according to claim 14 wherein the integral body comprises a plurality of cylindrical parts which line the cylinders, each cylindrical part having a respective wall thickness, the or each adjacent pair of cylindrical parts being connected together by a web, the thickness of the web along a line connecting the centres of the two cylindrical parts of the pair, being less than the combined wall thicknesses of the two cylindrical parts.

18. A cylinder block according to claim 17 wherein the cylinder liner has at least one integral wall part which provides a cooling passage through which coolant may subsequently flow when the cylinder block is in use and wherein the wall part extends between the outer surfaces of two adjacent cylindrical parts and the cooling passages provided between the wall part, the web and the outer surfaces of the two adjacent cylindrical parts.

19. A cylinder block according to claim 13 wherein the cylinder liner has at least one integral wall part which provides a cooling passage through which coolant may subsequently flow when the cylinder block is in use.

20. A cylinder block according to claim 13 wherein the cylinder block is a cylinder block of an internal combusion engine.

* * * * *